US011548279B2

(12) United States Patent
Katayama et al.

(10) Patent No.: US 11,548,279 B2
(45) Date of Patent: Jan. 10, 2023

(54) LIQUID DISCHARGE HEAD

(71) Applicant: Brother Kogyo Kabushiki Kaisha, Aichi-Ken (JP)

(72) Inventors: Shingo Katayama, Nisshin (JP); Toru Kakiuchi, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 40 days.

(21) Appl. No.: 17/176,790

(22) Filed: Feb. 16, 2021

(65) Prior Publication Data

US 2021/0252863 A1 Aug. 19, 2021

(30) Foreign Application Priority Data

Feb. 17, 2020 (JP) ..... JP2020-024596

(51) Int. Cl.
*B41J 2/14* (2006.01)
*B41J 2/165* (2006.01)

(52) U.S. Cl.
CPC ..... *B41J 2/14201* (2013.01); *B41J 2/16552* (2013.01); *B41J 2002/14419* (2013.01)

(58) Field of Classification Search
CPC ..... B41J 2/14201; B41J 2/16552; B41J 2002/14419; B41J 2002/14467; B41J 2202/05; B41J 2/14233; B41J 2/01
See application file for complete search history.

(56) References Cited

U.S. PATENT DOCUMENTS 10,549,532 B2 2/2020 Sugai et al.
2011/0181674 A1 7/2011 Kang et al.
2017/0282557 A1 10/2017 Murai et al.
2018/0281411 A1 10/2018 Katakura et al.
2018/0281443 A1 10/2018 Sakai et al.

FOREIGN PATENT DOCUMENTS

EP 1174274 A1 1/2002
GB 2548035 A 9/2017
JP 4247704 B2 * 4/2009 ..... B41J 2/1652
JP 2017-185676 A 10/2017
JP 2018-165004 A 10/2018
JP 2018-165005 A 10/2018

OTHER PUBLICATIONS

IP.com search (Year: 2022).*
Aug. 5, 2021—(EP) Extended EP Search Report—App 21156164.2.

* cited by examiner

*Primary Examiner* — Lisa Solomon
(74) *Attorney, Agent, or Firm* — Banner & Witcoff, Ltd.

(57) ABSTRACT

There is provided a liquid discharge head, including: a pressure chamber connected to a nozzle from which a liquid is discharged; an actuator configured to apply discharge pressure to the liquid in the pressure chamber; a first supply channel which is connected to the pressure chamber, and through which a first liquid is supplied to the pressure chamber; a second supply channel, different from the first channel, which is connected to the pressure chamber, and through which a second liquid different from the first liquid is supplied to the pressure chamber; a first valve which is disposed in the first supply channel, and by which the first supply channel is opened and closed; and a second valve which is disposed in the second supply channel, and by which the second supply channel is opened and closed.

13 Claims, 9 Drawing Sheets

LIQUID DISCHARGE HEAD

CROSS-REFERENCE TO RELATED APPLICATIONS

The present application claims priority from Japanese Patent Application No. 2020-024596, filed on Feb. 17, 2020, the disclosure of which is incorporated herein by reference in its entirety.

BACKGROUND

The present disclosure relates to a liquid discharge head.

As a conventional liquid discharge head, there is known a piezo ink-jet head described in Japanese Patent Application Laid-open No. 2017-185676. The head includes a nozzle from which an ink composition that contains a pigment is discharged, a pressure chamber for applying pressure to the ink composition so that the ink composition is discharged from the nozzle, and a connecting portion connecting the pressure chamber and the nozzle. An image is formed on a recording medium by the ink composition discharged from the nozzle.

SUMMARY

There is a demand for an industrial printing apparatus that discharges various kinds of liquid, such as an ink composition containing a pigment, like the head described in Japanese Patent Application Laid-open No. 2017-185676. However, providing a dedicated head for each liquid increases a size of an apparatus. On the other hand, if a tank connected to the head is replaced depending on the liquid to be discharged, a residual liquid needs to be discarded in order to inhibit the residual liquid from being mixed, in the head, with a new liquid. This wastes a lot of liquid.

The present disclosure has been made to solve the above problems, and an object of the present disclosure is to provide a liquid discharge head capable of reducing a waste liquid while inhibiting an increase in size of an apparatus.

A liquid discharge head according to an aspect of the present disclosure includes: a pressure chamber connected to a nozzle from which a liquid is discharged; an actuator configured to apply discharge pressure to the liquid in the pressure chamber; a first supply channel connected to the pressure chamber and through which a first liquid is supplied to the pressure chamber; a second supply channel connected to the pressure chamber and through which a second liquid different from the first liquid is supplied to the pressure chamber; a first valve disposed in the first supply channel and by which the first supply channel is opened and closed; and a second valve disposed in the second supply channel and by which the second supply channel is opened and closed.

Advantageous Effects of Invention

The above object, other objects, features, and advantages of the present disclosure will become apparent from the following detailed description of the preferred embodiments with reference to the accompanying drawings.

DESCRIPTION OF EMBODIMENTS

In the following, an embodiment of the present disclosure is explained specifically with reference to the drawings.

First Embodiment

<Configuration of Liquid Discharge Apparatus>

A liquid discharge apparatus 10 including a liquid discharge head (hereinafter referred to as a "head 20") according to a first embodiment of the present disclosure is an apparatus discharging a liquid. In the following, although examples in which the liquid discharge apparatus 10 is applied to an ink-jet printer which discharges a liquid such as ink are explained, the liquid discharge apparatus 10 is not limited thereto.

Figure 1:
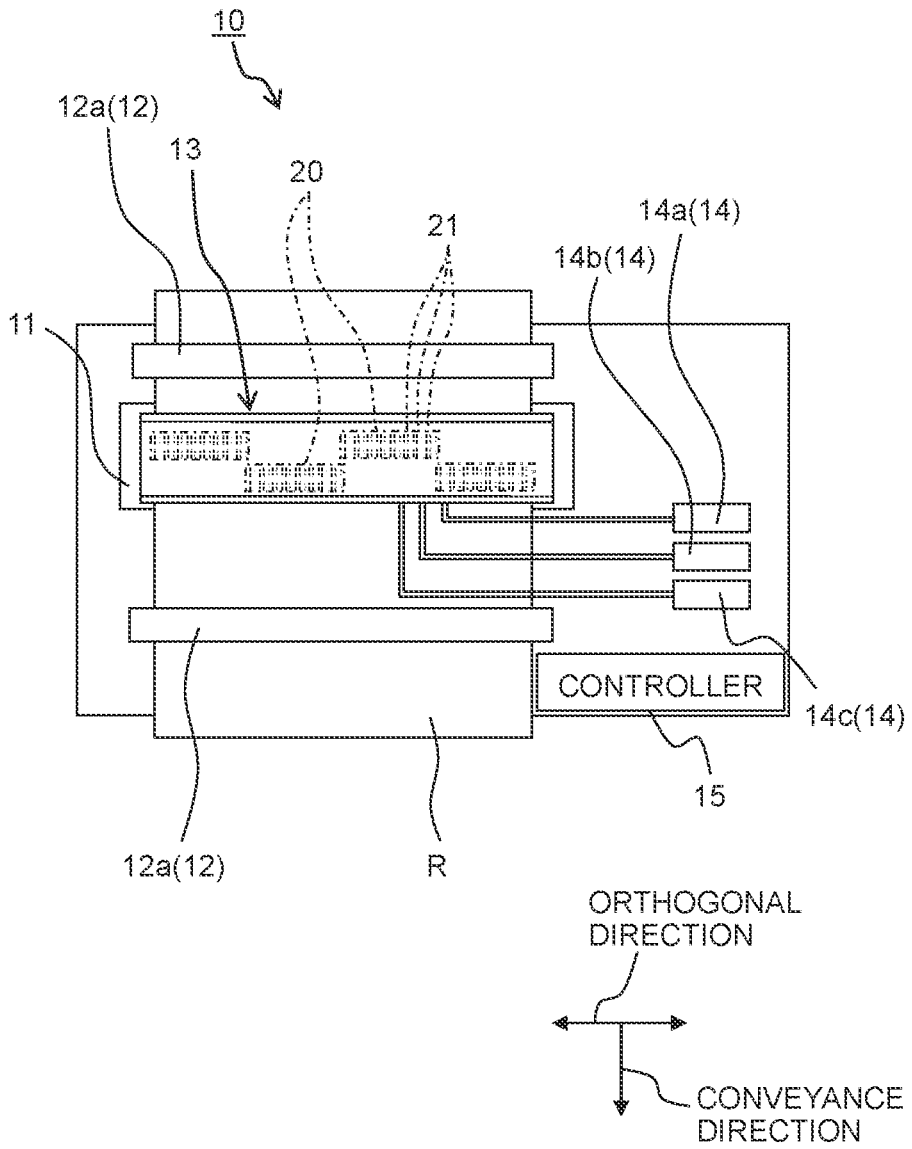
FIG. 1 schematically depicts a liquid discharge apparatus including a liquid discharge head according to a first embodiment of the present disclosure.

As depicted in FIG. 1, the liquid discharge apparatus 10 adopts a line head system. The liquid discharge apparatus 10 includes a platen 11, a conveyor 12, a head unit 13, tanks 14, and a controller 15. However, the liquid discharge apparatus 10 is not limited to the line head system, and any other system such as a serial head system may be adopted.

The platen 11 is a flat plate member. A recording medium R such as paper is disposed on an upper surface of the platen 11 to determine a distance between the head 20 and the recording medium R. The conveyor 12 has, for example, two conveyance rollers 12*a* and a conveyance motor. The two conveyance rollers 12*a* interpose the platen 11 therebetween in a conveyance direction. Central axes of the two conveyance rollers 12*a* are orthogonal to the conveyance direction so that they are parallel to each other. The two conveyance rollers 12*a* are coupled with the conveyance motor. Driving the conveyance motor rotates the conveyance rollers 12*a*, thereby conveying the recording medium R on the platen 11 in the conveyance direction.

The head unit 13 has a length not less than a length of the recording medium R in a direction orthogonal to the conveyance direction (orthogonal direction). The head unit 13 is provided with heads 20, and the heads 20 are arranged in the orthogonal direction. Each head 20 includes nozzles 21 and actuators 40 (FIG. 3). The nozzles 21 are opened in a lower surface of each head 20. When the actuators 40 are driven, meniscuses formed in the openings of the nozzles 21 vibrate and the liquid is discharged from the nozzles 21. Details of the head 20 are described below.

The tanks 14 include, for example, a first tank 14*a*, a second tank 14*b*, and a third tank 14*c*. The respective tanks 14 store different kinds of liquid. The tanks 14 are connected to the heads 20 via tubes. The liquids are exemplified, for example, by water-based pigment inks, printing pigment inks, water-based sublimation inks, reactive dye inks, acid dye inks, disperse dye inks, solvent inks, UV inks, latex inks, and cleaning liquids (cleaners).

The controller 15 includes an arithmetic section such as a CPU, storages such as a RAM and a ROM, and a driving section such as an ASIC. The controller 15 is connected to a variety of driver ICs and a variety of sensors. In the controller 15, the CPU receives a variety of requests and detection signals of the sensors. Then, the CPU causes the RAM to store a variety of data, and outputs a variety of execution instructions to the ASIC based on programs stored in the ROM. Based on the instructions, the ASIC controls the respective driver ICs and executes operations corresponding thereto. This drives the heads 20 and the conveyor 12.

For example, controller 15 executes a liquid discharge operation by the head(s) 20, a conveyance operation of the recording medium R by the conveyor 12, and the like. In the discharge operation, the liquid is discharged from the nozzles 21 by the driving of the actuators 40 of head(s) 20, and an image(s) is/are formed on the recording medium R by using the liquid. In the conveyance operation, driving the conveyance motor of the conveyor 12 conveys the recording medium R in the conveyance direction by a predefined amount. Accordingly, the images are arranged in the conveyance direction on the recording medium R in a printing process.

<Configuration of Head>

Figure 2:
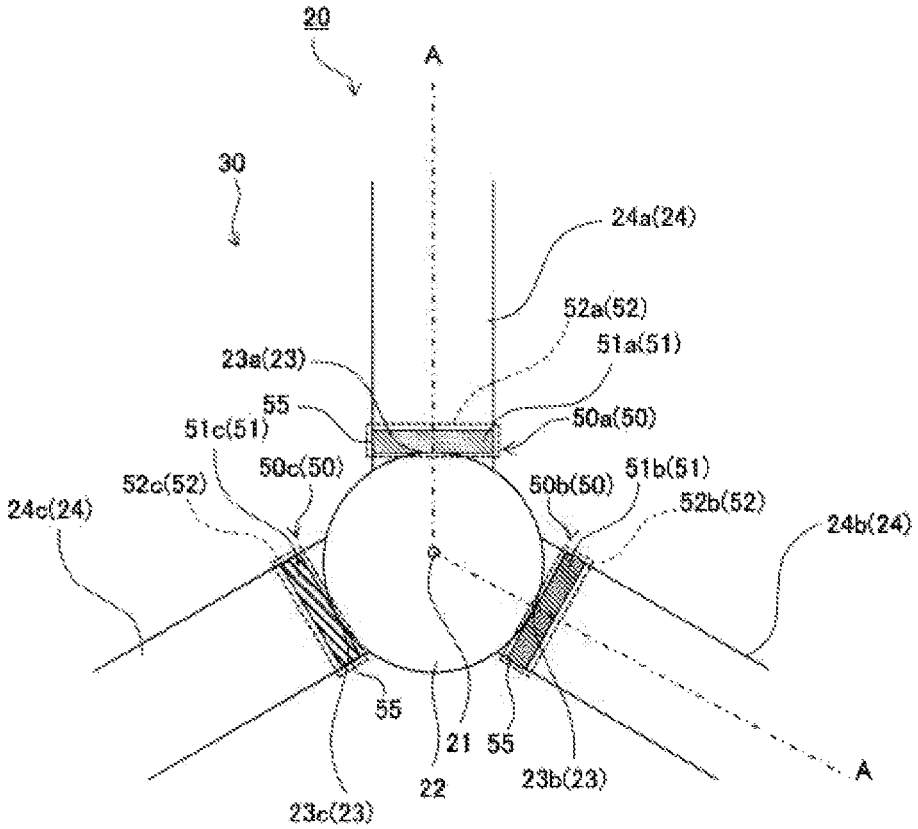
FIG. 2 is a cross-sectional view of a part of the liquid discharge head in FIG. 1 cut in a cross-section orthogonal to an up-down direction.
Figure 3A:
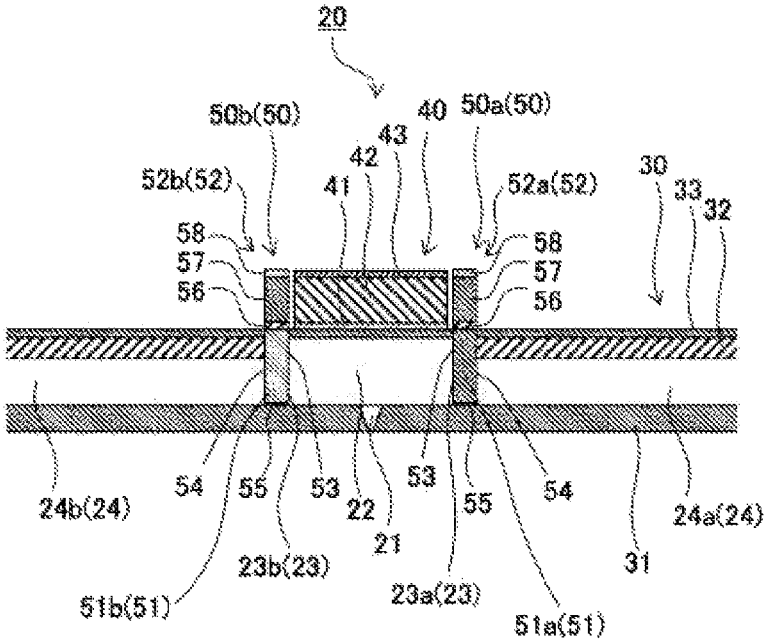
FIG. 3A is a cross-sectional view taken along a line A-A of FIG. 2.
Figure 3B:
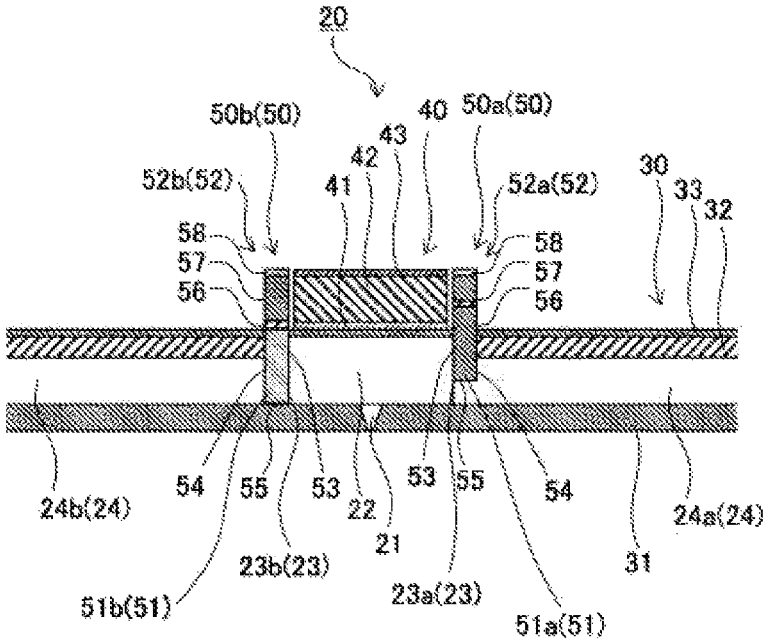
FIG. 3B depicts a state where a first supply channel is opened by a first valve in FIG. 3A.
Figure 4A:
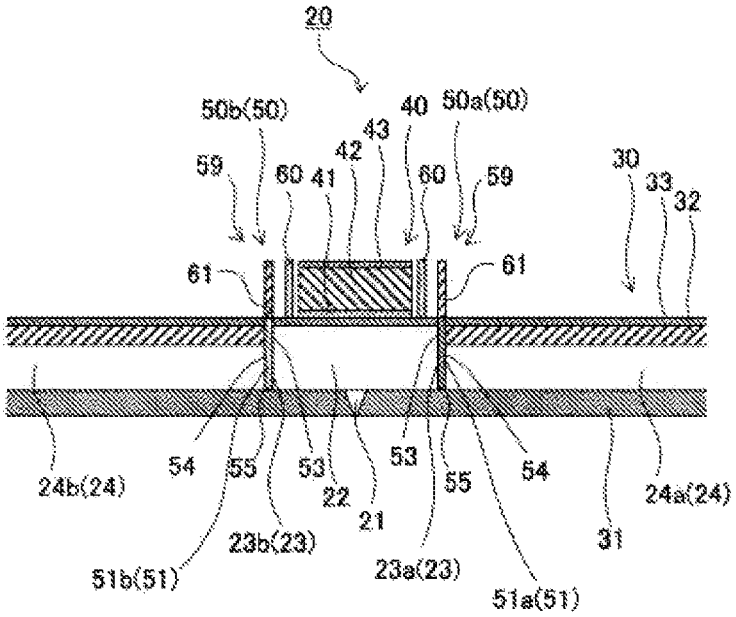
FIG. 4A is a cross-sectional view of a part of a liquid discharge head according to a first modified example of the first embodiment of the present disclosure cut in a cross-section parallel to the up-down direction.
Figure 4B:
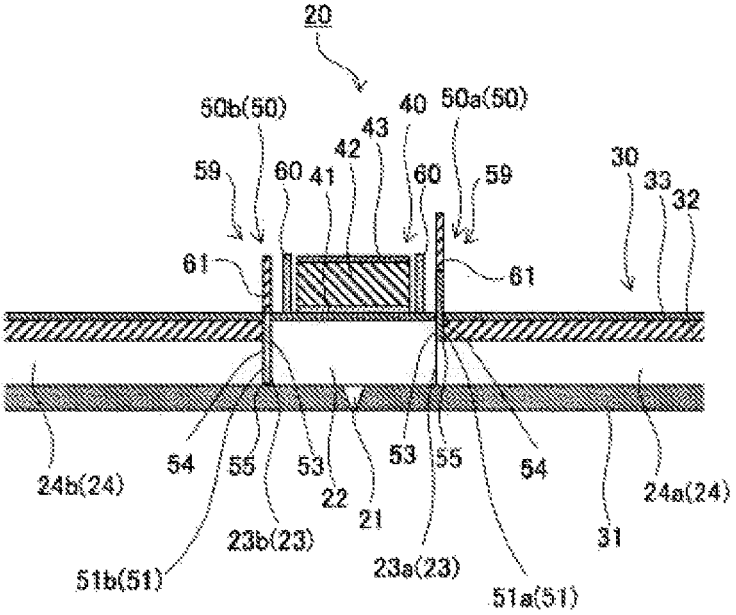
FIG. 4B depicts a state where the first supply channel is opened by the first valve in FIG. 4A.

As depicted in FIGS. 2, 3A, and 3B, each head 20 includes a channel forming body 30, the actuators 40, and valves 50. The channel forming body 30 is a stacked body of plates. The plates include a nozzle plate 31, a first channel plate 32, and a vibration plate 33. The plates are stacked from below in the above order in the up-down direction. Individual channels are formed in the channel forming body 30, and the individual channels are arranged in rows in an arrangement direction. A side closer to the first channel plate 32 relative to the nozzle plate 31 is referred to as an upper side, and a side opposite to the upper side is referred to as a lower side. The configuration of the head 20, however, is not limited thereto. The arrangement direction of the individual channels may be a direction which intersects with (e.g., orthogonal to) the up-down direction, and which is along the orthogonal direction (FIG. 1) or inclined to the orthogonal direction.

Each individual channel has the nozzle 21, the pressure chamber 22, and supply channels 24. The nozzle 21 passes through the nozzle plate 31 in the up-down direction. A front end of the nozzle 21 is opened in the lower surface of the nozzle plate 31. A central axis of the nozzle 21 extends in the up-down direction. The nozzle 21 has, for example, a cylindrical shape or a truncated conical shape in which a diameter of a distal end (an end at the lower side) is smaller than a diameter of a proximal end (an end at the upper side).

The pressure chamber 22 passes through the first channel plate 32 in the up-down direction. A lower end of the pressure chamber 22 is covered with the nozzle plate 31, and an upper end of the pressure chamber 22 is covered with the vibration plate 33. For example, the pressure chamber 22 has a columnar shape, such as a cylindrical shape, of which central axis extends in the up-down direction. The pressure chamber 22 and the nozzle 21 are arranged coaxially. The center of the lower end of the pressure chamber 22 is connected to the proximal end of the nozzle 21.

Upstream ends of the supply channels 24 are connected to the tanks 14 via tubes, manifolds, and the like. Downstream ends of the supply channels 24 are connected to the pressure chambers 22. The supply channels 24 include a first supply channel 24*a*, a second supply channel 24*b*, and a third supply channel 24*c*. The first supply channel 24*a* communicates with the first tank 14*a* (FIG. 1). A first liquid is supplied from the first tank 14*a* to the pressure chamber 22 through the first supply channel 24*a*. The second supply channel 24*b* communicates with the second tank 14*b* (FIG. 1). A second liquid is supplied from the second tank 14*b* to the pressure chamber 22 through the second supply channel 24*b*. The third supply channel 24*c* communicates with the third tank 14*c* (FIG. 1). A third liquid is supplied from the third tank 14*c* to the pressure chamber 22 through the third supply channel 24*c*. The flow rate of each liquid in each channel is, for example, 2 L/min.

The first supply channel 24*a*, the second supply channel 24*b*, and the third supply channel 24*c* are connected to the pressure chamber 22 at regular intervals in a circumferential direction of the pressure chamber 22 having the cylindrical shape. Connection openings 23 are provided in an outer circumferential surface of the pressure chamber 22 surrounding a central axis of the pressure chamber 22. The connection openings 23 have a first connection opening 23*a* connected to the first supply channel 24*a*, a second connection opening 23*b* connected to the second supply channel 24*b*, and a third connection opening 23*c* connected to the third supply channel 24*c*.

Each supply channel 24 is formed by a groove that is recessed from a lower surface of the first channel plate 32. An upper end of the supply channel 24 is covered with a portion included in the first channel plate 32 and positioned at the upper side of the groove, and a lower end of the supply channel 24 is covered with the nozzle plate 31. The supply channel 24 is thus formed in the channel forming body 30 and defined by an inner surface of the channel forming body 30. A lower surface of the supply channel 24 in the up-down direction is defined by an upper surface of the nozzle plate 31. Any other surface than the lower surface of the supply channel 24 is defined by an inner surface (a surface defining the groove) formed by the groove recessed from the lower surface of the first channel plate 32. Thus, the inner surface of the channel forming body 30 that defines the supply channel 24 is formed by the upper surface of the nozzle plate 31 and the inner surface of the first channel plate 32.

Each actuator 40 is an element for applying discharge pressure to the liquid in the pressure chamber 22. For example, the actuator 40 is formed by a piezoelectric element that includes a common electrode 41, a piezoelectric layer 42, and an individual electrode 43. The common electrode 41 covers an entire surface of the vibration plate 33 via an insulation film. The piezoelectric layer 42 is provided for each pressure chamber 22. The piezoelectric layer 42 is disposed on the common electrode 41 to overlap with the pressure chamber 22. The individual electrode 43 is provided for each pressure chamber 22. The individual electrode 43 is disposed on the piezoelectric layer 42. One actuator 40 is formed by one individual electrode 43, the common electrode 41, and the piezoelectric layer 42 (active portion) interposed between the individual electrode 43 and the common electrode 41.

The common electrode 41 is always kept at a ground potential. The individual electrode 43 is electrically connected to a driver IC for an actuator. When receiving a control signal from the controller 15 (FIG. 1), the driver IC generates a driving signal (voltage signal) and applies the driving signal to the individual electrode 43. In response to the driving signal, the active portion of the piezoelectric layer 42 contracts in a planar direction together with the common electrode 41 and the individual electrode 43, and the vibration plate 33 is deformed in cooperation with the actuator 40. That is, the vibration plate 33 is deformed in a direction in which the volume of the pressure chamber 22 increases and decreases, thus applying, to the pressure chamber 22, discharge pressure by which the liquid is discharged from the nozzle 21.

The valves 50 include a first valve 50*a*, a second valve 50*b*, and a third valve 50*c*. The first valve 50*a* is provided in the first supply channel 24*a* to open and close the first supply channel 24*a*. The second valve 50*b* is provided in the second supply channel 24*b* to open and close the second supply channel 24*b*. The third valve 50*c* is provided in the third supply channel 24*c* to open and close the third supply channel 24*c*. Each valve 50 is disposed adjacent to the connection opening 23 that connects each supply channel 24 and the pressure chamber 22. For example, an interval between the valve 50 and the connection opening 23 is smaller than a diameter or a size of the supply channel 24, preferably smaller than a diameter of the nozzle 21.

The first valve 50*a* includes a first valve body 51*a* and a first piezoelectric element 52*a* that moves the first valve body 51*a*. The second valve 50*b* includes a second valve body 51*b* and a second piezoelectric element 52*b* that moves the second valve body 51*b*. The third valve 50*c* includes a third valve body 51*c* and a third piezoelectric element 52*c* that moves the third valve body 51*c*. Each of the first valve body 51*a*, the second valve body 51*b*, and the third valve body 51*c* is referred simply as a valve body 51 in some cases. Each of the first piezoelectric element 52*a*, the second piezoelectric element 52*b*, and the third piezoelectric element 52*c* is referred simply as a piezoelectric element 52 in some cases.

The diameter or a size of the valve body 51 is larger than the diameter or the size of the connection opening 23. The valve body 51 can cover the connection opening 23. The valve body 51 has a pair of surfaces (facing surface 53, opposite surface 54) and a circumferential edge 55 (including, for example, side edges or surfaces and a lower edge or surface). The valve body 51 is disposed so that the pair of surfaces is parallel to the up-down direction. The facing surface 53 faces the connection opening 23. The opposite surface 54 is disposed on a side opposite to the facing surface 53. The circumferential edge 55 is disposed between the facing surface 53 and the opposite surface 54. The circumferential edge 55 is disposed parallel to an extending direction of the supply channel 24.

The valve body 51 has a shape in which the circumferential edge 55 is brought into contact with the inner surface of the channel forming body 30 that defines the supply channel 24, in a state where the valve body 51 closes the supply channel 24. The valve body 51 is formed by an elastic material. The elastic material is formed by a material having durability against liquid, such as silicon resin. At least any one of the first valve body 51*a*, the second valve body 51*b*, and the third valve body 51*c* is formed by the elastic material. It is not limited to the case where the entirety of the valve body 51 is formed by the elastic material. A part of the valve body 51 may be formed by the elastic material such that, for example, the circumferential edge 55 of the valve body 51 is formed by the elastic material.

The piezoelectric element 52 is a driving section (drive) that moves the valve body 51. The piezoelectric element 52 includes a common electrode 56, a piezoelectric layer 57, and an individual electrode 58. The common electrode 56, the piezoelectric layer 57, and the individual electrode 58 have similar configurations as the common electrode 41, the piezoelectric layer 42, and the individual electrode 43, respectively. The common electrode 56 is always kept at the ground potential. The individual electrode 58 is electrically connected to a driver IC for valves. The piezoelectric element 52 expands and contracts in the up-down direction by the driving signal from the driver IC for valves.

As depicted in FIG. 3A, in a state where the piezoelectric element 52 is expanded, the circumference edge 55 of the valve body 51 is brought into contact with the inner surface of the channel forming body 30, and a lower end of the circumferential edge 55 is brought into contact with the upper surface of the nozzle plate 31. In this situation, the valve body 51 covers the connection opening 23 to block the flowing of the liquid in the supply channel 24. On the other hand, as depicted in FIG. 3B, in a state where the piezoelectric element 52 is contracted, the lower end of the circumferential edge 55 of the valve body 51 is separated from the nozzle plate 31, thus forming a space between the circumferential edge 55 of the valve body 51 and the inner surface of the channel forming body 30. The valve body 51 thus opens the connection opening 23, making it possible to the flowing of liquid in the supply channel 24.

<Method of Controlling Liquid Discharge Apparatus>

The liquid discharge apparatus 10 performs, for example, printing by using a liquid that contains a pigment (pigment ink) and a liquid that contains a dye (dye ink). In this case, the first tank 14*a* stores the pigment ink, the second tank 14*b* stores the dye ink, and the third tank 14*c* stores a cleaner.

When printing is performed using the pigment ink, as depicted in FIG. 3A, the controller 15 drives the piezoelectric element 52 of each valve 50 to move each valve body 51 downward. In this situation, all the connection openings 23 (the first connection opening 23*a*, the second connection opening 23*b*, and the third connection opening 23*c*) are closed with all the valves 50 (the first valve 50*a*, the second valve 50*b*, and the third valve 50*c*). The flowing of liquid in the first supply channel 24*a*, the second supply channel 24*b*, and the third supply channel 24*c* is blocked by the first valve body 51*a*, the second valve body 51*b*, and the third valve body 51*c*, respectively.

As depicted in FIG. 3B, the controller 15 then drives the first piezoelectric element 52*a* to move the first valve body 51*a* upward. This opens the first connection opening 23*a*, and the first liquid flows from the first tank 14*a* to the first supply channel 24*a*, is supplied to the pressure chamber 22 via the first connection opening 23*a*, and flows into the nozzle 21 from the pressure chamber 22.

Here, the controller 15 drives the actuator 40 based on printing data obtained, changing the volume of the pressure chamber 22. Pressure is thus applied from the pressure chamber 22 to the first liquid in the nozzle 21, discharging the first liquid from the nozzle 21. An image is printed on the recording medium R by the pigment ink that is the first liquid discharged.

When printing by using the pigment ink is changed to printing by using the dye ink, the controller 15 drives the first piezoelectric element 52*a* to move the first valve body 51*a* downward, as depicted in FIG. 3A. This closes all the connection openings 23 (the first connection opening 23*a*, the second connection opening 23*b*, and the third connection opening 23*c*) with all the valves 50 (the first valve 50*a*, the second valve 50*b*, and third valve 50*c*), respectively. In this state, the controller 15 drives the actuator 40 to discharge the first liquid remained in the first supply channel 24*a*, the pressure chamber 22, and the nozzle 21 from the nozzle 21.

Then, the controller 15 drives the third piezoelectric element 52*c* to move the third valve body 51*c* upward. This opens the third connection opening 23*c*, and the third liquid from the third tank 14*c* flows through the third supply channel 24*c*, is supplied to the pressure chamber 22 via the third connection opening 23*c*, and flows into the nozzle 21 from the pressure chamber 22. After that, the controller 15 drives the third piezoelectric element 52*c* to move the third valve body 51*c* downward. The third connection opening 23*c* is thus closed with the third valve 50*c*. The controller 15 drives the actuator 40 to discharge the third liquid from the nozzle 21. The pressure chamber 22 and the nozzle 21 are thus cleaned with a cleaner that is the third liquid.

Subsequently, the controller 15 drives the second piezoelectric element 52*b* to move the second valve body 51*b* upward. This opens the second connection opening 23*b*, and the second liquid from the second tank 14*b* flows through the second supply channel 24*b*, is supplied to the pressure chamber 22 via the second connection opening 23*b*, and flows into the nozzle 21 from the pressure chamber 22.

Here, the controller 15 drives the actuator 40 based on the printing data obtained to change the volume of the pressure chamber 22. Pressure is thus applied from the pressure chamber 22 to the second liquid in the nozzle 21, discharging the second liquid from the nozzle 21. An image is printed on the recording medium R by the dye ink that is the second liquid discharged.

<Working Effect>

In the head 20, the supply channels 24 are connected to each pressure chamber 22. Each of the valves 50 is provided in the corresponding one of the supply channels 24. Since the supply channels 24 share the pressure chamber 22 and the actuator 40, it is possible to inhibit the increase in size of an apparatus (such as, the liquid discharge apparatus 10). Further, for example, when a liquid is changed from the first liquid to the second liquid, the first liquid remained in the pressure chamber 22 is discarded by closing the first valve 50*a* and opening the second valve 50*b*. This reduces an amount of liquid discarded.

In the head 20, each valve 50 includes the valve body 51 and the piezoelectric element 52 that moves the valve body 51. It is possible to open and close each supply channel 24 with each valve 50 while inhibiting the increase in size of an apparatus (such as, the liquid discharge apparatus 10) by using the piezoelectric element 52 in the driving section that moves the valve body 51.

In the head 20, the cleaner is used as one of the multiple kinds of liquid. It is thus possible to clean the pressure chamber 22 and the nozzle 21 with the cleaner when the kind of liquid is changed. This inhibits different kinds of liquid from being mixed, which inhibits clogging of the nozzle 21 caused by condensation; mixture of colors; and the like.

In the head 20, the circumferential edge 55 of the valve body 51 brought into contact with the inner surface of the channel forming body 30 is formed from the elastic material. Thus, in a state where the connection opening 23 is closed with the valve 50, the elasticity of the elastic material causes the valve body 51 to be deformed along the inner surface of the channel forming body 30, and the circumferential edge 55 of the valve body 51 is brought into tight contact with the inner surface. This inhibits the liquid from leaking from the supply channel 24 to the pressure chamber 22.

In the head 20, each of the valves 50 is disposed in the vicinity of the corresponding one of the connection openings 23. It is thus possible to reduce an amount of liquid to be discarded when the kind of liquid is changed. Further, since a cleaning range is narrow (only the pressure chamber 22 and the nozzle 21), a cleaning time can be shortened.

Further, the nozzles 21 are provided in the head 20, and the valves 50 are provided in the supply channels 24 connected to the nozzles 21 via the pressure chambers 22. The liquid can thus be supplied to the respective nozzles 21. Thus, when the cleaner is used as the liquid, the cleaner is supplied only to the clogged nozzle(s) 21 by controlling the opening/closing of the valve(s) 50, so that the clogged nozzle(s) 21 is/are cleaned. This reduces the wasteful consumption of the cleaner.

In the head 20, the pressure chamber 22 has the columnar or cylindrical shape. The first supply channel 24*a*, the second supply channel 24*b*, and the third supply channel 24*c* are connected to the pressure chamber 22 at regular intervals in the circumferential direction of the pressure chamber 22. The actuator 40 thus applies pressure equally or uniformly to the liquid from the upper side of the pressure chamber 22. A direction in which the liquid is discharged from the nozzle 21 is thus not likely to be deviated from a predefined direction. Further, air bubbles are not likely to remain or stay in the pressure chamber 22, thus reducing discharge failure caused by air bubbles.

First Modified Example

In the head 20 according to a first modified example, each of the first valve 50*a*, the second valve 50*b*, and the third valve 50*c* includes the valve body 51 and an electrostatic element 59 that moves the valve body 51. Since the head 20 according to the first modified example is same as or similar to the head 20 according to the first embodiment except for the element moving the valve body 51, explanation for same or similar features is omitted.

The electrostatic element 59 is provided in the valve 50. The electrostatic element 59 is a driving section (drive) for moving the valve body 51. An electrostatic micro actuator is used, for example, as the electrostatic element 59. The electrostatic element 59 includes a fixed electrode 60 and a movable electrode 61. The fixed electrode 60 and the movable electrode 61 are formed by a conductive material. The fixed electrode 60 and the movable electrode 61 are arranged at an interval in a direction orthogonal to the up-down direction. The movable electrode 61 is provided to be displaceable with respect to the fixed electrode 60. The movable electrode 61 is connected to the valve body 51. The fixed electrode 60 is grounded. The movable electrode 61 is electrically connected to the controller 15. When the controller 15 applies voltage from the driver IC to the movable electrode 61, electrostatic force generated drives the movable electrode 61 to move the valve body 51 connected to the movable electrode 61 upward.

The connection opening 23 is opened and closed by moving the valve body 51 by use of the electrostatic element 59. A moving distance of the valve body 51 by using the electrostatic element 59 can be larger than that by using the piezoelectric element 52, and the increase in the size of the head 20 can be inhibited. The valve 50 thus opens and closes the connection opening 23 more efficiently.

Second Modified Example

Figure 5:
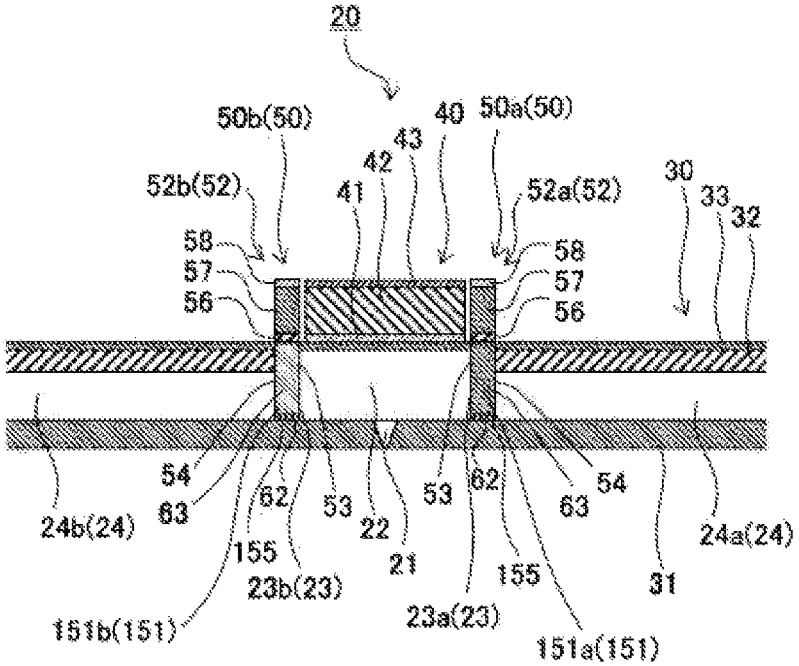
FIG. 5 is a cross-sectional view of a part of a liquid discharge head according to a second modified example of the first embodiment of the present disclosure cut in a cross-section parallel to the up-down direction.

The head 20 according to a second modified example includes a first valve body 151*a*, a second valve body 151*b*, and a third valve body 151*c*. As depicted in FIG. 5, in at least any one of the first valve body 151*a*, the second valve body 151*b*, and the third valve body 151*c*, a circumferential edge 155 brought into contact with the inner surface of the channel forming body 30 is formed by a silicon coating film 62. Except for the valve bodies 151, the head 20 of the second modified example is same as or similar to the head 20 of the first embodiment, and thus explanation for same or similar features is omitted.

The valve bodies 151 each include a main body 63 and the silicon coating film 62. The main body 63 has the facing surface 53, the opposite surface 54 (disposed at a side opposite to the facing surface 53), and a side surface therebetween. The main body 63 is formed from a material having durability against liquid. The side surface of the valve body 151 is coated with the silicon coating film 62, and the silicon coating film 62 forms the circumferential edge 155 of the valve body 151. The silicon coating film 62 is formed by silicon resin having durability against liquid. The silicon coating film 62 is provided in the circumferential edge 155 of the valve body 151 by coating the side surface of the main body 63 with silicon resin.

In a state where the connection opening 23 is closed with the valve 50, the silicon coating film 62 of the circumferential edge 155 of the valve body 151 is brought into contact with the inner surface of the channel forming body 30. In this situation, the silicon coating film 62 having elasticity is deformed along the inner surface, and the circumferential edge 155 of the valve body 151 is brought into tight contact with the inner surface. It is thus possible to inhibit the liquid from leaking from the supply channel 24 to the pressure chamber 22.

Third Modified Example

Figure 6A:
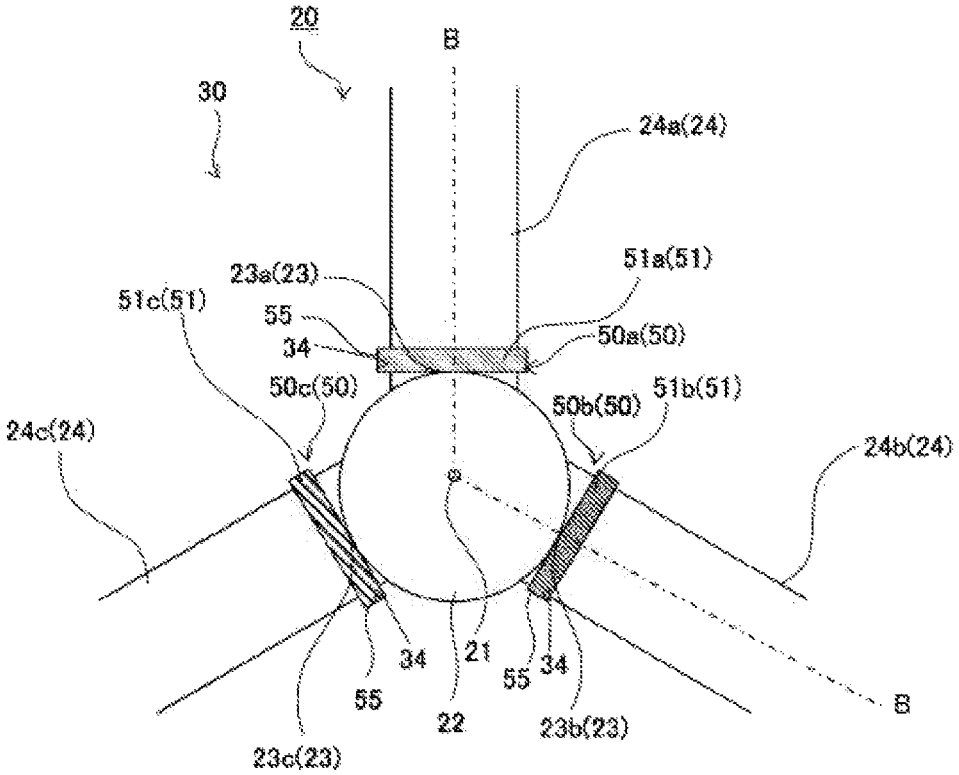
FIG. 6A is a cross-sectional view of a part of a liquid discharge head according to a third modified example of the first embodiment of the present disclosure cut in a cross-section orthogonal to the up-down direction.
Figure 6B:
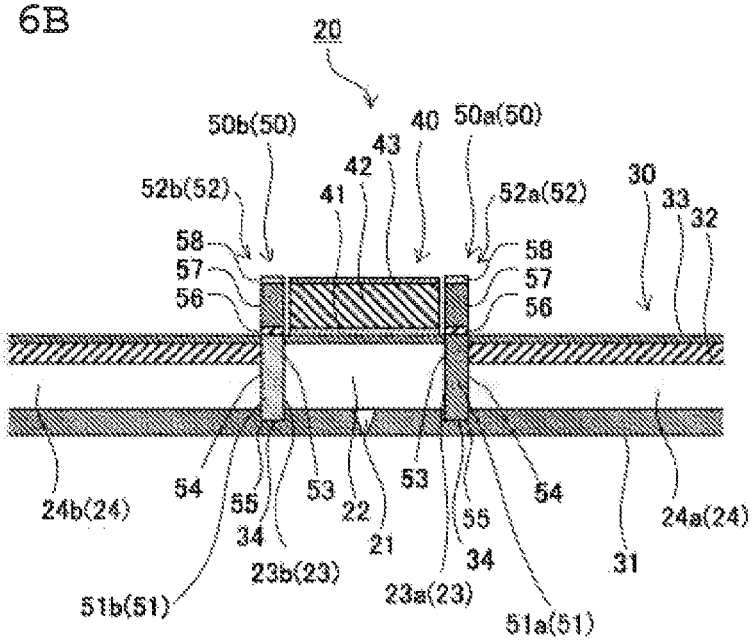
FIG. 6B is a cross-sectional view taken along a line B-B in FIG. 6A.

As depicted in FIGS. 6A and 6B, in the head 20 according to a third modified example, a recess 34, into which the circumferential edge 55 of at least any one of the first valve body 51*a*, the second valve body 51*b*, and the third valve body 51*c* is fitted, is provided in the inner surface of the channel forming body 30. Except for this, the head 20 according to the third modified example is same as or similar to the head 20 according to the first embodiment, and thus explanation for same or similar features is omitted.

The supply channel 24 is formed by a groove that is recessed from the lower surface of the first channel plate 32. The lower surface of the first channel plate 32 is stacked on the upper surface of the nozzle plate 31. Thus, the inner surface of the channel forming body 30 defining the supply channel 24 is formed by the upper surface of the nozzle plate 31 and the inner surface (surface defining the groove) of the first channel plate 32 formed by the groove. The recess 34 recessed from the supply channel 24 is formed in the above upper surface and inner surface.

A diameter or a size of a portion included in the supply channel 24 and formed having the recess 34 is larger than a diameter or a size of any other portion than said portion, and is slightly larger than a diameter or a size of the valve body 51. In the extending direction of the supply channel 24, a distance (a size) between a pair of surfaces defining the recess 34 is slightly longer than a distance (a thickness) between the facing surface 53 and the opposite surface 54 of the valve body 51. The pair of surfaces defining the recess 34 is formed by a surface facing the facing surface 53 of the valve body 51 and a surface facing the opposite surface 54 of the valve body 51.

As described above, the circumferential edge 55 of the valve body 51 is fitted in the recess 34, and the valve body 51 overlaps with the surface defining the recess 34 of the channel forming body 30 in the extending direction of the supply channel 24. It is thus possible to inhibit the liquid from leaking from the supply channel 24 to the pressure chamber 22.

Fourth Modified Example

Figure 7:
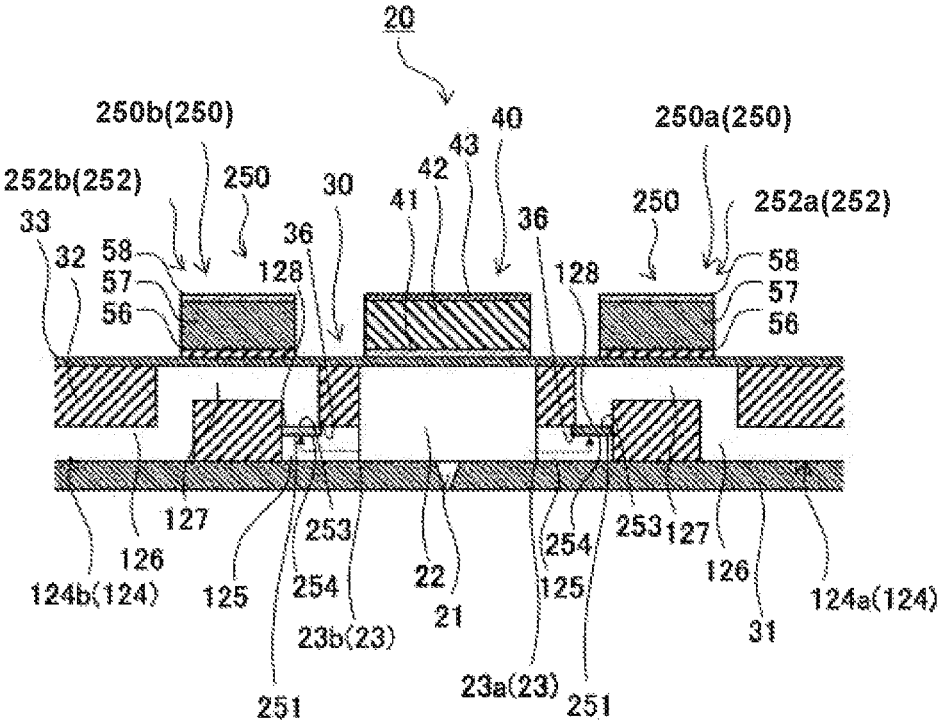
FIG. 7 is a cross-sectional view of a part of a liquid discharge head according to a fourth modified example of the first embodiment of the present disclosure cut in a cross-section parallel to the up-down direction.

In the head 20 according to a fourth modified example, as depicted in FIG. 7, at least any one of a first supply channel 124*a*, a second supply channel 124*b*, and a third supply channel 124*c* has a downstream portion 125 connected to the pressure chamber 22 and an upstream portion 126 communicating with the downstream portion 125. The valve disposed in the supply channel 124 has a valve body 251 provided in the downstream portion 125 and a check valve 250 that inhibits liquid from flowing back to the upstream portion 126 from the downstream portion 125. Except for this, the head 20 according to the fourth modified example is same as or similar to the head 20 according to the first embodiment, and thus explanation for same or similar features is omitted.

Specifically, the supply channel 124 has the upstream portion 126 and the downstream portion 125. An upstream end of the upstream portion 126 is connected to the tank 14, and a downstream part of the upstream portion 126 is bent into an inverted U-shape. This bent portion 127 extends upward toward the downstream side, extends in an extending direction of the supply channel 124, and then extends downward. An upstream end of the downstream portion 125 is connected to a downstream end of the upstream portion 126 via a communication opening 128, and a downstream end of the downstream portion 125 is connected to the pressure chamber 22. The downstream portion 125 and the upstream portion 126 except for the bent portion 127 are formed by a groove recessed from the lower surface of the first channel plate 32. The bent portion 127 is formed by a recess recessed from an upper surface of the first channel plate 32. An upper end of the bent portion 127 is thus covered with the vibration plate 33.

The check valve 250 is provided in the supply channel 124 having the upstream portion 126 and the downstream portion 125. The check valve 250 includes the valve body 251 and a piezoelectric element 252 moving the valve body 251. The valve body 251 is disposed in the downstream portion 125. The valve body 251 is disposed in the vicinity of the communication opening 128 to open and close the communication opening 128. A facing surface 253 of the valve body 251 faces the communication opening 128. The piezoelectric element 252 is disposed on the bent portion 127 of the supply channel 124 via the vibration plate 33. The piezoelectric element 252 applies, to liquid in the bent portion 127, pressure that moves the valve body 251 so as to open and close the communication opening 128. The valve body 251 may be disposed to face the connection opening 23. Also in this case, the valve body 251 is moved by pressure applied by the piezoelectric element 252 to open and close the connection opening 23 while inhibiting backflow from the pressure chamber 22.

In a standby state before liquid discharge as depicted in FIG. 7, neither the actuator 40 nor the piezoelectric element 252 is driven and no pressure is applied to the liquid in the pressure chamber 22 and the bent portion 127. In this case, the communication opening 128 is covered with the facing surface 253 of the valve body 251, and liquid pressure is applied to the opposite surface 254 of the valve body 251. The valve body 251 is thus pressed against a valve seat 36. This causes the check valve 250 to close the supply channel 124, inhibiting liquid from flowing back to the supply channel 124 from the pressure chamber 22.

Figure 8A:
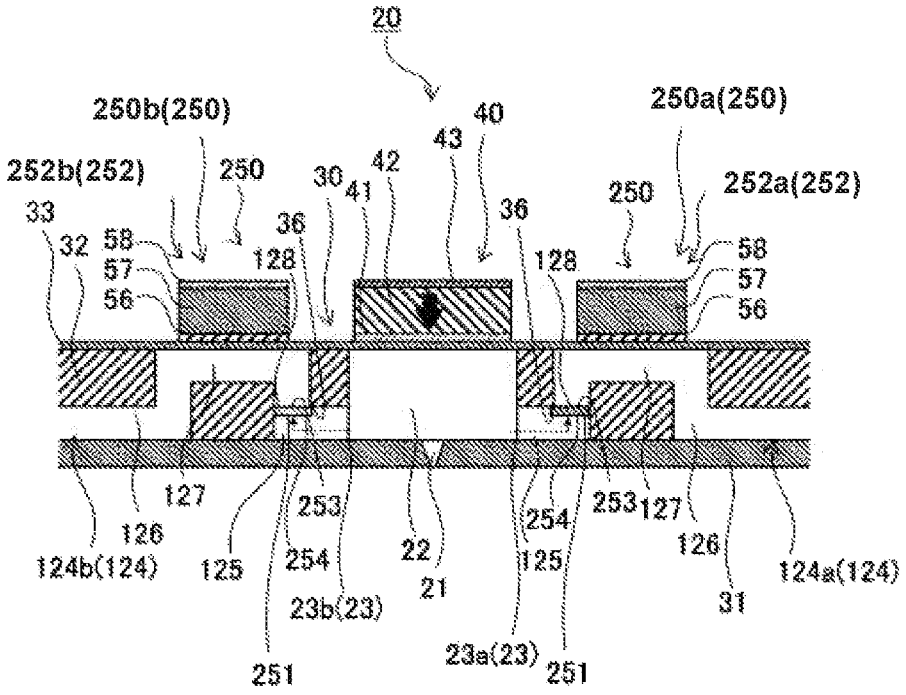
FIGS. 8A and 8B are illustrative views for explaining a case where a first liquid is discharged from a first supply channel in FIG. 7.

When the first liquid flowing from the first supply channel 124*a* is discharged from the nozzle 21, the actuator 40 is first driven to reduce the volume of the pressure chamber 22, as depicted in FIG. 8A. This applies pressure to the first liquid in the nozzle 21 via the pressure chamber 22, and the first liquid is discharged from the nozzle 21.

Figure 8B:
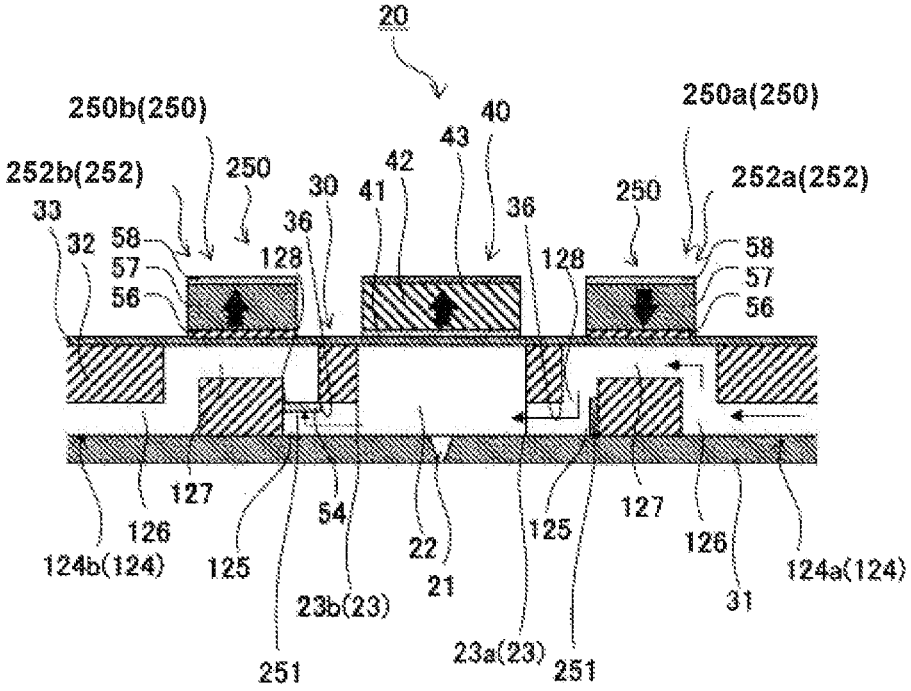

Subsequently, as depicted in FIG. 8B, the actuator 40 is driven to cause the pressure chamber 22 to recover an original volume, and the first piezoelectric element 252*a* is driven to reduce the volume of the bent portion 127 of the first supply channel 124*a*. This causes the valve body 251 of the first valve 250*a* to separate from the valve seat 36, thus opening the communication opening 128 of the first supply channel 124*a*. The first liquid thus flows into the pressure chamber 22 from the first supply channel 124*a*.

In this situation, the second piezoelectric element 252*b* is driven to increase the volume of the bent portion 127 of the second supply channel 124*b*, and the third piezoelectric element 252*c* is driven to increase the volume of the bent portion 127 of the third supply channel 124*c*. Thus, the valve body 251 of the second valve 250*b* is attracted to the communication opening 128 of the second supply channel 124*b* so that the communication opening 128 is covered therewith, and the valve body 251 of the third valve 250*c* is attracted to the communication opening 128 of the third supply channel 124*c* so that the communication opening 128 is covered therewith. Since the flowing of liquid from the second supply channel 124*b* and the third supply channel 124*c* to the pressure chamber 22 is blocked, the first liquid is reliably supplied from the first supply channel 124*a* to the pressure chamber 22 in a state where the mixture of liquid is inhibited.

Then, each of the piezoelectric elements 252*a* to 252*c* is driven to recover an original volume of the bent portion 127. Liquid discharge from the nozzle 21 depicted in FIG. 8A and liquid supply to the pressure chamber 22 depicted in FIG. 8B are repeated.

Fifth Modified Example

Figure 9A:
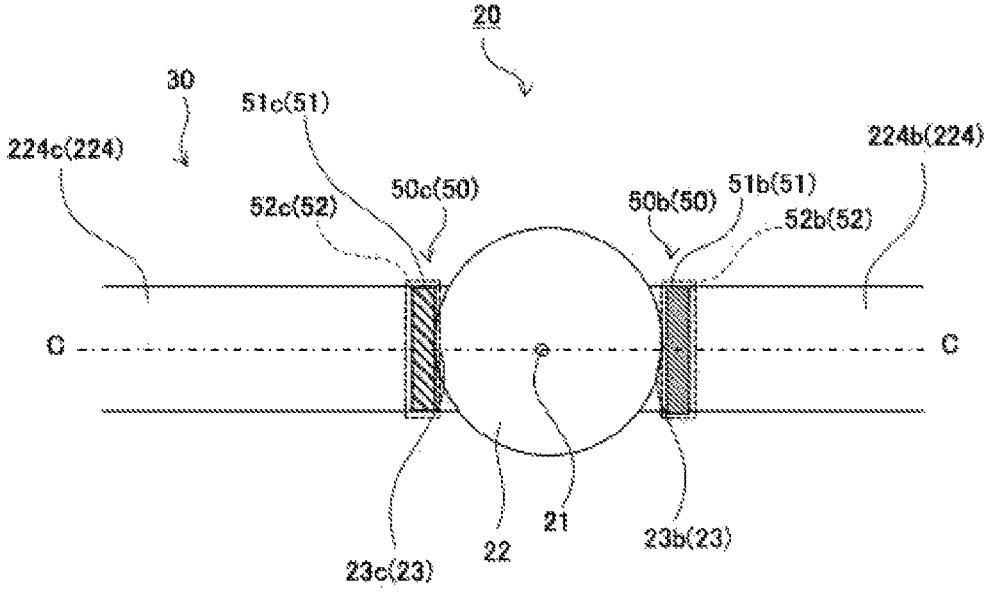
FIG. 9A is a cross-sectional view of a part of a liquid discharge head according to a fifth modified example of the first embodiment of the present disclosure cut in a cross-section orthogonal to the up-down direction.
Figure 9B:
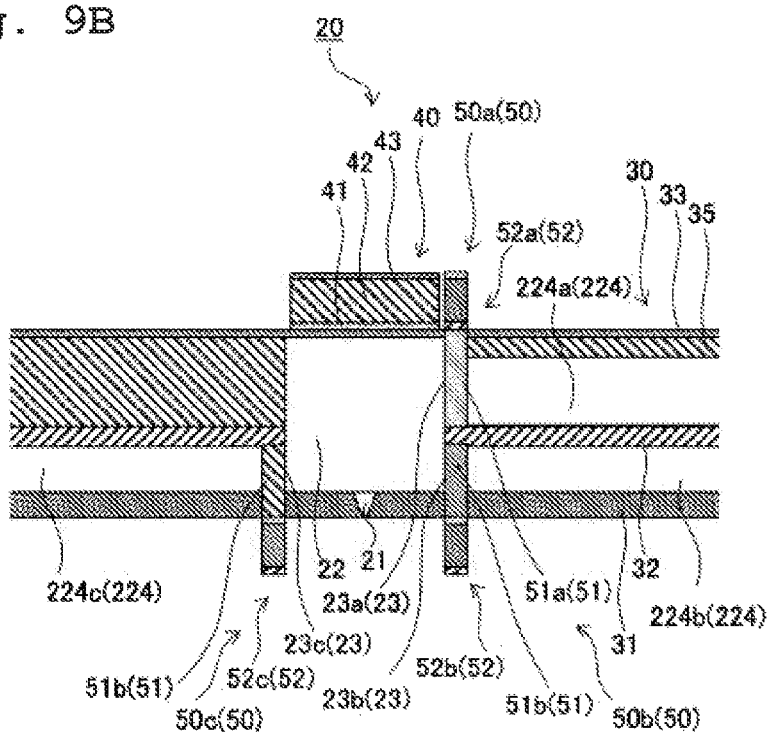
FIG. 9B is a cross-sectional view taken along a line C-C in FIG. 9A.

In the head 20 according to a fifth modified example, as depicted in FIGS. 9A and 9B, a first supply channel 224*a* and a second supply channel 224*b* are stacked, and they are disposed at a side opposite to a third supply channel 224*c* with the pressure chamber 22 interposed between the channels 224*a*, 224*b* and the channel 224*c*. Except for this, the head 20 according to the fifth modified example is same as or similar to the head 20 according to the first embodiment, and thus explanation for same or similar features is omitted.

The channel forming body 30 further includes a second channel plate 35. The second channel plate 35 is disposed between the first channel plate 32 and the vibration plate 33 in the up-down direction. The pressure chamber 22 passes through the first channel plate 32 and the second channel plate 35 in the up-down direction. The lower end of the pressure chamber 22 is covered with the nozzle plate 31, and the upper end thereof is covered with the vibration plate 33.

The second supply channel 224*b* and the third supply channel 224*c* are formed by a groove recessed from the lower surface of the first channel plate 32. An upper end of each of the second supply channel 224*b* and the third supply channel 224*c* is covered with a portion included in the first channel plate 32 and positioned at the upper side of the groove, and a lower end thereof is covered with the nozzle plate 31. The first supply channel 224*a* is formed by a groove recessed from a lower surface of the second channel plate 35. An upper end of the first supply channel 224*a* is covered with a portion included in the second channel plate 35 and positioned at the upper side of the groove, and a lower end of the first supply channel 224*a* is covered with the first channel plate 32.

The first supply channel 224*a* is disposed on the second supply channel 224*b*. The second supply channel 224*b* and the third supply channel 224*c* are arranged linearly with the pressure chamber 22 interposed therebetween. For example, three supply channels 224*a* to 224*c* extend in a direction intersecting with (e.g., orthogonal to) its arrangement direction. In the pressure chamber 22, the first connection opening 23*a* and the second connection opening 23*b* are arranged in the up-down direction, and the second connection opening 23*b* faces the third connection opening 23*c*.

For example, there may be a case where the three supply channels 224*a* to 224*c* extend from the pressure chamber 22 in mutually different directions and a case where the three supply channels 224*a* to 224*c* extend from the pressure chamber 22 in two directions. A size in a direction orthogonal to the two directions of the latter case can be small. It is thus possible to arrange the supply channels 224 while inhibiting the increase in size of the head 20.

In the first valve 50*a*, the first piezoelectric element 52*a* is positioned at the upper side of the first valve body 51*a*. The first valve body 51*a* moves downward to cover the first connection opening 23*a*, and moves upward to open the first connection opening 23*a*. In the second valve 50*b*, the second piezoelectric element 52*b* is positioned at the lower side of the second valve body 51*b*. The second valve body 51*b* moves upward to cover the second connection opening 23*b*, and moves downward to open the second connection opening 23*b*. In the third valve 50*c*, the third piezoelectric element 52*c* is positioned at the lower side of the third valve body 51*c*. The third valve body 51*c* moves upward to cover the third connection opening 23*c*, and moves downward to open the third connection opening 23*c*.

Other Modified Examples

The heads 20 according to the first embodiment and all the modified examples each have the first supply channel, the second supply channel, and the third supply channel. The number of the supply channels is not limited thereto. For example, the head 20 may have only two supply channels (e.g., the first supply channel and the second supply channel) or four or more supply channels.

All the above embodiments may be combined provided that no contradiction or exclusion is caused. For example, the second modified example may be applied to the first modified example, the third modified example may be applied to the first and second modified examples, the fourth modified example may be applied to the first to third modified examples, and the fifth modified example may be applied to the first to fourth modified examples.

From the above description, many modifications and other embodiments of the present disclosure are apparent to those skilled in the art. The above description should thus be interpreted as just examples, and is provided to teach those skilled in the art the best mode for carrying out the present disclosure. Details about the configurations and/or the functions described above may be substantially changed without departing from the gist of the present disclosure.

INDUSTRIAL APPLICABILITY

The liquid discharge head of the present disclosure is useful, for example, as a liquid discharge head that is capable of reducing a waste liquid while inhibiting an increase in size of an apparatus.

The present disclosure has the above configuration, and has an effect of providing the liquid discharge head that reduces the waste liquid while inhibiting the increase in size of an apparatus.

What is claimed is:

1. A liquid discharge head, comprising:

a pressure chamber connected to a nozzle from which a liquid is discharged;

an actuator configured to apply discharge pressure to the liquid in the pressure chamber;

a first supply channel which is connected to the pressure chamber, and through which a first liquid is supplied to the pressure chamber;

a second supply channel, different from the first supply channel, which is connected to the pressure chamber, and through which a second liquid different from the first liquid is supplied to the pressure chamber;

a first valve which is disposed in the first supply channel, and by which the first supply channel is opened and closed; and a second valve which is disposed in the second supply channel, and by which the second supply channel is opened and closed, wherein the liquid discharge head is a stacked body of plates in which the pressure chamber, the first supply channel, the second supply channel, the first valve and the second valve are positioned.

2. The liquid discharge head according to claim 1, wherein each of the first valve and the second valve includes a valve body and a piezoelectric element configured to move the valve body.

3. The liquid discharge head according to claim 1, wherein each of the first valve and the second valve includes a valve body and an electrostatic element configured to move the valve body.

4. The liquid discharge head according to claim 1, comprising a channel forming body in which the first supply channel is formed, and which has an inner surface defining the first supply channel, wherein at least one of the first valve and the second valve has a valve body and a drive configured to move the valve body.

5. The liquid discharge head according to claim 4, wherein the valve body has a circumferential edge which is capable of abutting the inner surface and which is formed by an elastic material.

6. The liquid discharge head according to claim 4, wherein the valve body has a circumferential edge which is capable of abutting the inner surface and which is formed by a silicon coating film.

7. The liquid discharge head according to claim 4, wherein the inner surface is formed having a recess into which a circumferential edge of the valve body is to be fitted.

8. The liquid discharge head according to claim 1, wherein a supply channel, which is at least one of the first supply channel and the second supply channel, has a downstream portion connected to the pressure chamber and an upstream portion communicating with the downstream portion, and a valve arranged at the supply channel, which is at least one of the first valve and the second valve, is a check valve which has a valve body provided in the downstream portion, and which is configured to inhibit the liquid from flowing back to the upstream portion from the downstream portion.

9. The liquid discharge head according to claim 1, wherein at least one of the first liquid and the second liquid is any of a water-based pigment ink, a printing pigment ink, a water-based sublimation ink, a reactive dye ink, an acid dye ink, a disperse dye ink, a solvent ink, a UV ink, a latex ink, and a cleaning liquid.

10. The liquid discharge head according to claim 1, further comprising: a third supply channel which is connected to the pressure chamber, and through which a third liquid different from the first and second liquids is supplied to the pressure chamber, and a third valve which is disposed in the third supply channel, and by which the third supply channel is opened and closed.

11. The liquid discharge head according to claim 10, wherein the pressure chamber has a cylindrical shape, and the first supply channel, the second supply channel, and the third supply channel are connected to the pressure chamber at regular intervals in a circumferential direction of the pressure chamber.

12. The liquid discharge head according to claim 10, wherein the first supply channel and the second supply channel are stacked on each other, and the first supply channel and the second supply channel are arranged at a side opposite to a side of the third supply channel with the pressure chamber interposed between the first and second supply channels and the third supply channel.

13. The liquid discharge head according to claim 1, wherein the second supply channel is connected to the pressure chamber without being connected to the first supply channel.

* * * * *